US011713903B2

(12) United States Patent
Dalgarno et al.

(10) Patent No.: US 11,713,903 B2
(45) Date of Patent: Aug. 1, 2023

(54) DUCTING SYSTEMS

(71) Applicants: Michael Ronald Dalgarno, Abridge (GB); Kenneth James Dalgarno, Abridge (GB)

(72) Inventors: Michael Ronald Dalgarno, Abridge (GB); Kenneth James Dalgarno, Abridge (GB)

( * ) Notice: Subject to any disclaimer, the term of this patent is extended or adjusted under 35 U.S.C. 154(b) by 0 days.

(21) Appl. No.: 15/308,496

(22) PCT Filed: May 7, 2014

(86) PCT No.: PCT/GB2014/000175
§ 371 (c)(1),
(2) Date: Nov. 2, 2016

(87) PCT Pub. No.: WO2015/170062
PCT Pub. Date: Nov. 12, 2015

(65) Prior Publication Data

US 2017/0051942 A1 Feb. 23, 2017

(51) Int. Cl.
*F16L 23/14* (2006.01)
*F24F 13/02* (2006.01)

(52) U.S. Cl.
CPC ..... *F24F 13/0263* (2013.01); *F24F 13/0209* (2013.01)

(58) Field of Classification Search
CPC ..... F16L 23/14; F24F 13/0263; F24F 13/0209
USPC ..... 285/47, 48, 55, 45; 138/112, 111, 116, 138/117
See application file for complete search history.

(56) References Cited

U.S. PATENT DOCUMENTS 2,359,952 A * 10/1944 Welger ..... F16L 33/28 285/368
2,378,272 A * 6/1945 Whitaker ..... F16L 9/003 138/161

(Continued)

FOREIGN PATENT DOCUMENTS

CH 671084 A5 7/1989
EP 0891511 B1 7/2003

(Continued)

OTHER PUBLICATIONS

U.K. Intellectual Property Office, Search Report issued in corresponding Application No. GB 1220484.8, dated May 23, 2014.

(Continued)

*Primary Examiner* — Aaron M Dunwoody
(74) *Attorney, Agent, or Firm* — Stites & Harbison, PLLC; David W. Nagle, Jr.; James R. Hayne

(57) ABSTRACT

The invention discloses a duct section for an air distribution system, the duct sections including an elongate frame having two opposed flange members each having an opening forming an air passage therein. A plurality of the duct sections are able to be joined together through the flanges to form an air passage of desired length. Each duct section is lined with a thermal insulating material to provide a thermally insulating lining to the air passage, the ends of the lining being at least flush with the end faces of the flanges so that when adjacent duct sections are secured together, the thermal insulation lining of adjacent duct sections is arranged to provide a continuous insulating lining of the air passage.

24 Claims, 4 Drawing Sheets

3

(56) References Cited

U.S. PATENT DOCUMENTS 2,408,960 A * 10/1946 Stivason ..... F16L 27/1012 285/368
2,489,048 A * 11/1949 Rinehart ..... F16L 9/21 138/149
3,251,382 A * 5/1966 Tatsch ..... F16L 9/003 138/151
3,889,581 A * 6/1975 Bray, Sr. ..... F16L 23/14 126/299 E
4,132,382 A * 1/1979 Jackson ..... F16K 7/07 138/109
4,280,536 A * 7/1981 Gnant ..... F16L 9/003 138/147
5,219,403 A * 6/1993 Murphy ..... F16L 9/003 137/561 A
5,673,947 A * 10/1997 De Waal ..... F16L 23/14 285/364
5,762,109 A * 6/1998 Matthews ..... F16L 59/143 138/149
5,918,644 A * 7/1999 Haack ..... F16L 9/003 138/146
5,944,060 A * 8/1999 MacKay ..... F16L 23/14 138/137
5,953,818 A * 9/1999 Matthews ..... B32B 3/30 29/890.144
5,975,146 A * 11/1999 Lardillat ..... F16L 59/147 138/149
6,231,704 B1 * 5/2001 Carpinetti ..... F16L 9/003 138/149
6,622,818 B2 * 9/2003 Jenvey ..... F01N 1/24 181/224
8,104,796 B2 * 1/2012 Stefani ..... F16L 23/12 285/368
8,186,387 B2 * 5/2012 Wadsworth ..... F16L 55/0336 138/143
8,206,821 B2 * 6/2012 Librizzi ..... A61L 2/238 428/319.1
8,667,995 B1 * 3/2014 Fanelli ..... F24F 13/0245 138/112
8,695,644 B2 * 4/2014 Rowan ..... F16L 9/003 138/149
9,528,261 B2 * 12/2016 Sandoe ..... E04B 1/7662
2005/0116470 A1 * 6/2005 Duffy ..... F16L 23/14 285/424

FOREIGN PATENT DOCUMENTS

| | | | |
|---|---|---|---|
| EP | 2042796 | A1 | 4/2009 |
| GB | 1498865 | A | 1/1978 |
| GB | 2269868 | B | 2/1994 |
| JP | S63-134905 | | 4/1990 |
| JP | H02-13608 | | 11/1991 |
| WO | 90/07081 | A1 | 6/1990 |
| WO | 93/16321 | A1 | 8/1993 |
| WO | 2012/056083 | A1 | 5/2012 |

OTHER PUBLICATIONS

Japan Patent Office, Notification of Reasons for Refusal issued in corresponding Application No. 2017-510776, dated Feb. 27, 2018.

* cited by examiner

DUCTING SYSTEMS

BACKGROUND OF THE INVENTION

The present invention relates to ducting systems and particularly to a duct for an air distribution system.

Ducting systems for the distribution of ventilating or heating air are widely used in offices, warehouses, shops and factories. In many installations, it is a requirement for the ducts to be thermally insulated. Typically, this is done by first erecting the entire ducting system and when it is in place covering the outside of the ducting with a thermal insulating layer. There are a number of disadvantages with this arrangement. Since the ducting is typically placed high off the ground, it is necessary to erect scaffolding for the workers installing the thermal installation, but there is still a significant risk of falls which creates a safety hazard. The productivity of workers working under these conditions is inevitably lower than if they were working at ground level. It frequently occurs also that there are difficulties in accessing certain parts of the ducting, where this is close to the roof of example. Furthermore, it is difficult to monitor and check the quality and the uniformity of the installation with the result that gaps may be formed in the installation which leads to cold spots and the risk of condensation forming in the ducts.

There are therefore a number of disadvantages with the existing system which risk compromising the integrity of the insulation and also make it very costly to install. The present invention seeks to provide a practical solution to these problems.

SUMMARY OF THE INVENTION

According to the present invention there is provided a duct section for an air distribution system, the duct section including an elongate frame having two opposed flange members each having an opening forming an air passage therein, by which flanges a plurality of the duct sections are able to be joined together to form an air passage of desired length, wherein, each duct section is lined with a thermal insulating material to provide a thermally insulating lining to the air passage, the lining being at least flush with the end faces of the flanges so that when adjacent duct sections are secured together, the thermal insulation lining of adjacent duct sections is arranged to provide a continuous insulating lining of the air passage.

Preferably, the frame comprises a tubular element having the flanges at opposed ends. Preferably, the frame comprises a plurality of elongate frame elements secured about the periphery of the flange members to define the elongate frame, thermal insulation boarding being secured between adjacent frame elements to define the air passage and to form the insulating lining.

Advantageously, an insulating gasket is disposed between the adjoined flanges. Preferably, the end faces of the insulating lining which abut when two sections are joined, are sealed with a foil tape or hardcast seal.

In a preferred embodiment, the lining material is secured to the duct by a mastic adhesive. In this case, an air gap may be formed between the inner surface of the duct and the insulating lining, the air gap at the ends of a ducts section being closed by mastic adhesive. Preferably, the insulating lining material and/or the gasket is formed of an expanded or foamed plastics material as a phenolic resin based material.

Preferably, the flange members are rectangular and are joined by four elongate frame elements secured to respective apices of the flange members.

Preferably, the frame elements each have swages or folds therein to improve the bending resistance of the element.

Preferably, the flange members each have a web extending outwardly from the flange member over the insulating board with means to secure the board to the web, and when the flange members are rectangular, the flange members each have a web on each side of the right angle to enable all four sections of the insulating boarding to be secured to the frame members. Preferably, the flange members are formed from planar sheet material, the web being formed from the sheet so as to extend outwardly at a right angle from the plane of the flange member so as to overlie the insulating boarding.

Preferably, the insulating boarding extends, through the flange members to lie flush with or slightly proud of the exterior surface of the flange members.

The insulating boarding may comprise a foamed or expanded plastics material, which may be of a phenolic resin or polyisocyanurate. Alternatively, the insulating boarding is formed of a mineral or natural wool based material. In all forms, the insulating boarding may have a closed cell vapour proof skin and/or a class 'O' foil faced plastic laminate vapour barrier skin/facing and/or a pure aluminium foil applied at manufacture to prevent moisture ingress.

Preferably, when the duct is a rectangular tube, the insulating boarding is formed of a single sheet of material having V-shaped grooves cut along fold lines to enable the board to be folded into a rectangular tube for feeding into the chassis to form the duct passage.

Preferred embodiments of the present invention will now be described by way of example with reference to the accompanying drawing which:—

DETAILED DESCRIPTION OF THE INVENTION

Figure 1:
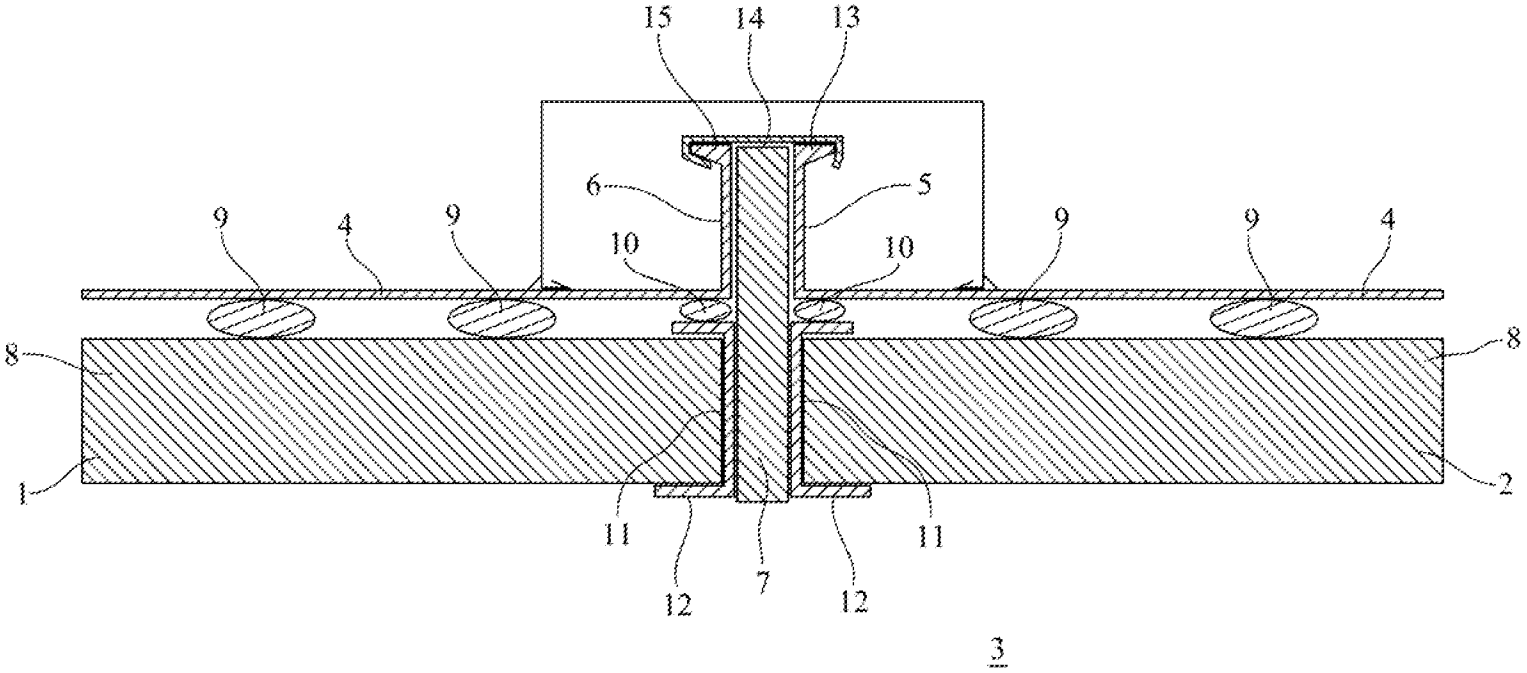
FIG. 1 shows a sectional side view of two duct sections joined together.

Referring now to FIG. 1 there is shown a longitudinal cross-section through one wall of two duct sections 1, 2 which are of rectangular cross-section. Reference 3 shows the relationship of the duct housing 2 and air passage 3 extending through both duct sections 1, 2. The duct sections 1, 2 are farmed of sheet steel walls 4 and each have at their ends upstanding flanges 5, 6 by which adjacent duct sections can be secured together by bolts or rivets (not shown) passing through both flanges 5, 6. In this embodiment, a gasket 7 forms a joint seal of a foamed plastics or butyl material and is located between the flanges 5, 6 to provide thermal insulation. Each duct section 1, 2 is lined with a thermal insulating lining 8 of thermal insulating lining material comprising a foam or expanded synthetic plastics material such as a laminated phenolic based board.

The insulating lining 8 is secured to the inner face of the duct wall 4 by means of a mastic adhesive 9 which forms a small air gap between the lining material 8 and the inner surface of the duct wall 4. At the ends of the duct sections 1, 2, the air gap is closed by further mastic adhesive 10. To prevent the ends 11 of the insulating lining being damaged during transit or assembly, the ends 11 are sealed by a foil tape 12 or hardcast material to seal and protect the ends. When the ducting is used on external applications such as the outside of roofs, additional mastic material may be used on the outside. The external edge 13 of the flanges 5, 6 and the gasket 14 are preferably closed by a weather cap 15 clipped onto the outside periphery and sealed with a mastic adhesive. In an alternative form for interior use, a decorative cap may be used.

Figure 2:
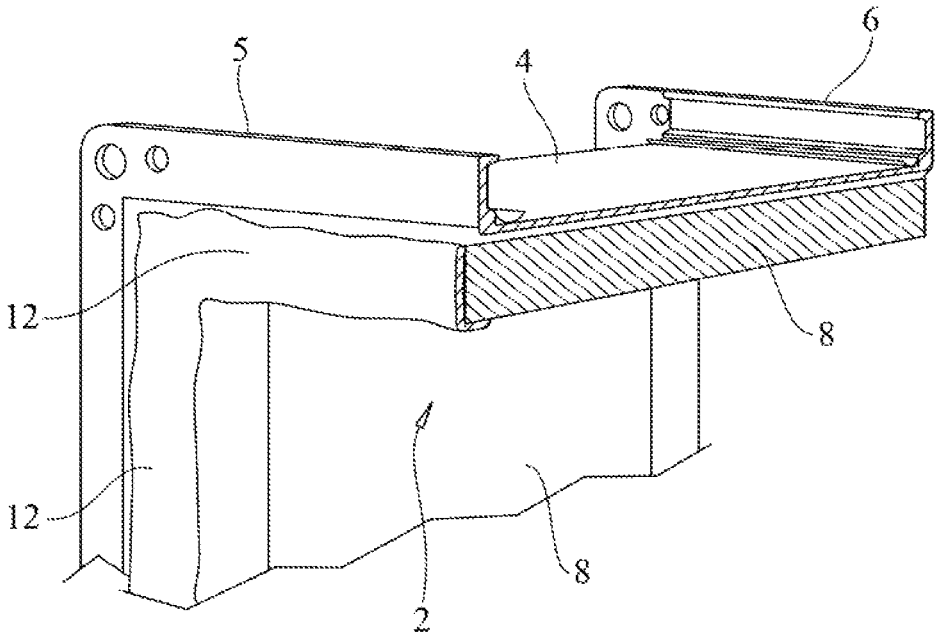
FIG. 2 shows a perspective view of part of a duct section having a rectangular cross-section.
Figure 3:
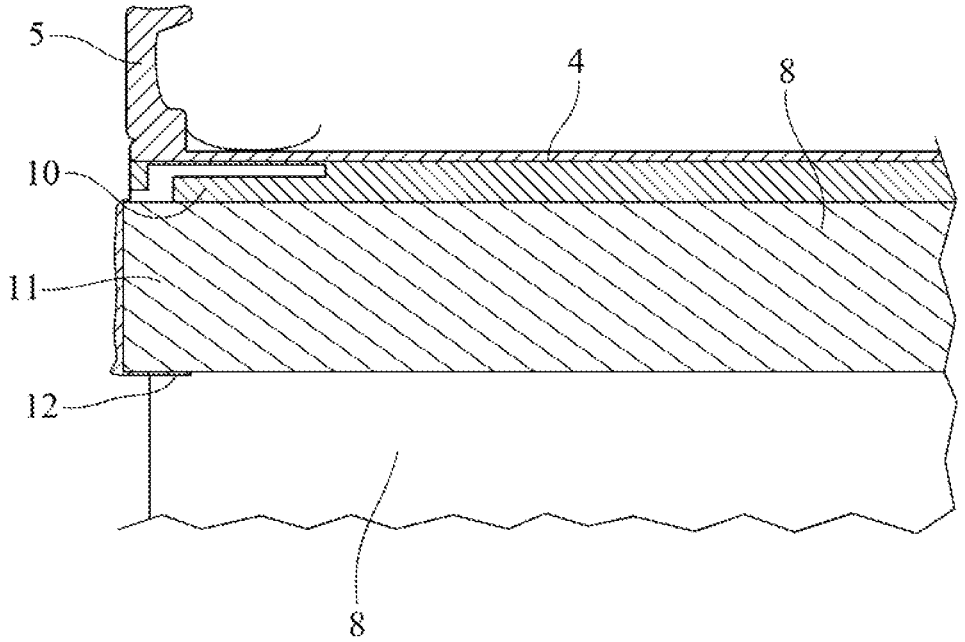
FIG. 3 shows a sectional side view of an end of a duct section.

As shown more clearly in FIGS. 2 and 3, the lining material is in the form of insulation board 8 which lines the interior of the rectangular ducting 5, 6, the ends 11 of adjacent sheets abutting to ensure that there is no air gap. FIG. 3 in particular illustrates the air gap between the lining material and the inner surface of the duct wall 4 with the air gap being sealed by mastic adhesive. It can be seen in FIG. 3 that the lining material 8 projects very slightly from the end of the duct section to ensure that no gap is formed between adjacent duct sections 1, 2 when they are secured together.

As can be seen from these embodiments, the present invention has the advantage that the duct insulation can be carried out in a factory controlled conditions which ensures accuracy of the insulation and greatly facilitates the monitoring and checking of the assembly. This results in enhanced thermal insulation. The fact that the installation is on the interior of the ducting reduces the risk of damage in transit and installation and also reduces the risk of damage being caused in use by birds and/or vermin, which reduces maintenance costs.

There is also a considerable saving in cost of installation since, there is only one stage of installation rather than the known system of two, the first being the installation of the ducting and then a second team has to be used to install the insulation.

Although the embodiment illustrated is a rectangular cross-section duct, the present invention is equally applicable to circular or oval ducts. In the described embodiment, the lining material consists of boards which are secured to the interior of the duct by means of a mastic adhesive. Alternative methods of construction may be used, such as spraying a foamed plastics material onto the interior surface. Although described as being for an air distribution system, the term air should be construed broadly to include other gases such as carbon dioxide-enhanced air as used in horticulture, or gases in industrial processes.

Figure 4:
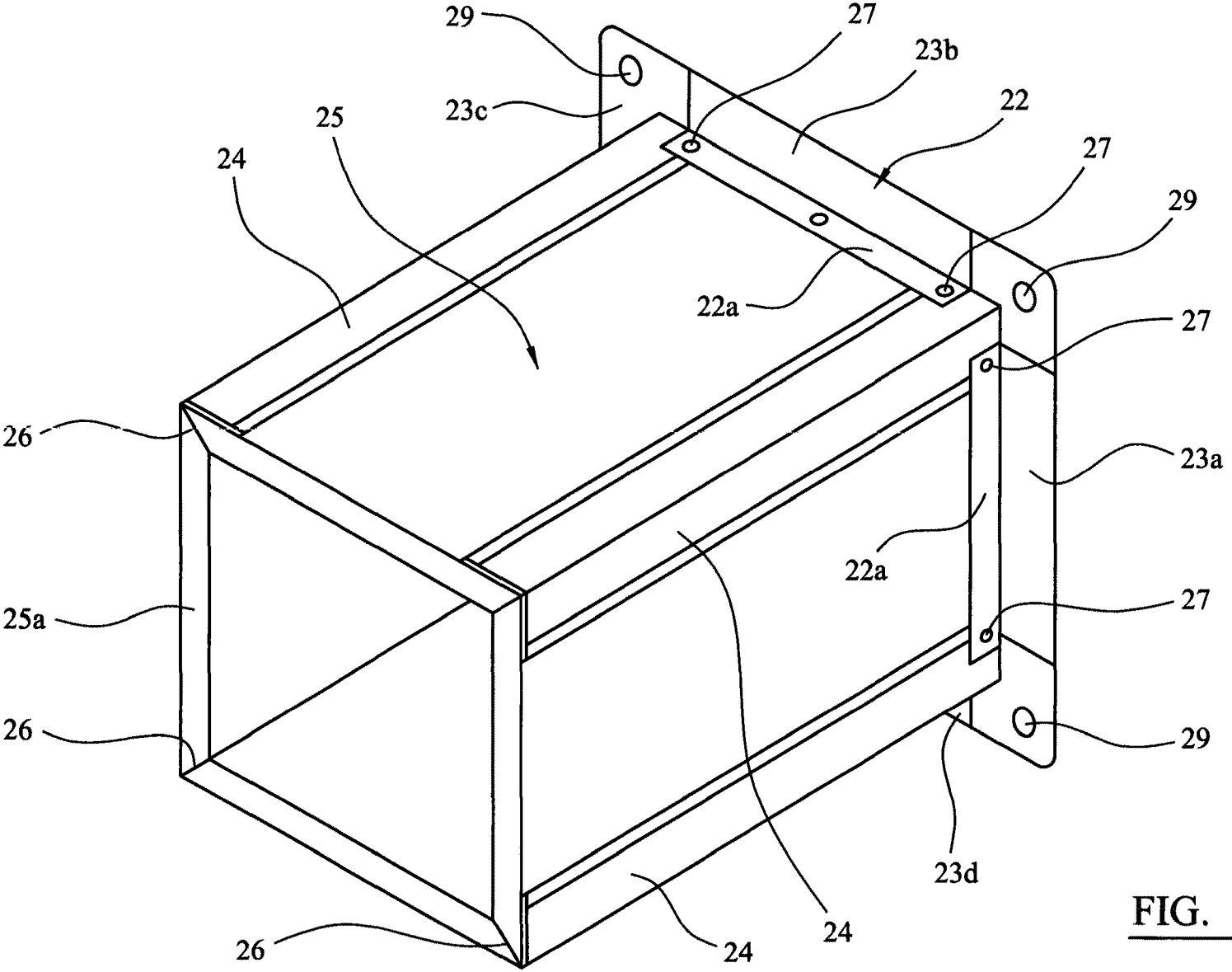
FIG. 4 shows a schematic perspective view of a duct member for an air distribution system.

Referring now to FIG. 4 there is shown a schematic perspective view of a duct member forming part of a duct for an air distribution system. The duct member consists of two opposed flange members 22, only one of which is shown in the interests of clarity. Each flange member consists of a substantially rectangular planar body having four sides 23*a* to 23*d*, which enclose an opening which defines the cross-sectional area of the duct. On each of the sides of the flange member a web 22*a* is formed extending at right angles to the plane of the flange towards the other flange member. Four elongate frame elements 24 extend between the associated apices of the corners of the flange members 22 to secure the two flanges together by means of screws 27 in a spaced relationship to form a chassis, the length of the frame elements 24 defining the length of the section.

The elongate frame elements 24 are L-shaped in cross-section and are strengthened by being rolled over at the edges or having swages or recesses (not shown) which serve to strengthen the element against bending stresses.

The chassis thus formed is completely open but it is closed by, making a duct wall from a thermally insulating boarding 25. The boarding consists of a foamed or expanded plastics material such as a phenolic resin or polyisocyanurate. Alternative thermal insulation materials such as mineral wool, natural wool or reconstituted paper may be used. Preferably, the board 25 is covered with a closed cell vapour proof skin and/or a class 'O' foil faced plastic laminate vapour barrier skin/facing and/or a pure aluminium foil applied at manufacture to prevent moisture ingress.

As shown, the ducting includes four walls made from the boarding in the rectangular duct member shown. The four walls are made from a single sheet of boarding in which appropriately spaced grooves are formed by cutting a 90° Vee groove about which the boarding is hinged to form a rectangular tube defining the duct. The tube is then inserted in the end of the duct and pushed in until the end faces 25*a* of the tube are aligned with the outer surfaces of the two flanges 22 or to project slightly outside the plane of the flange outer faces.

Figure 5:
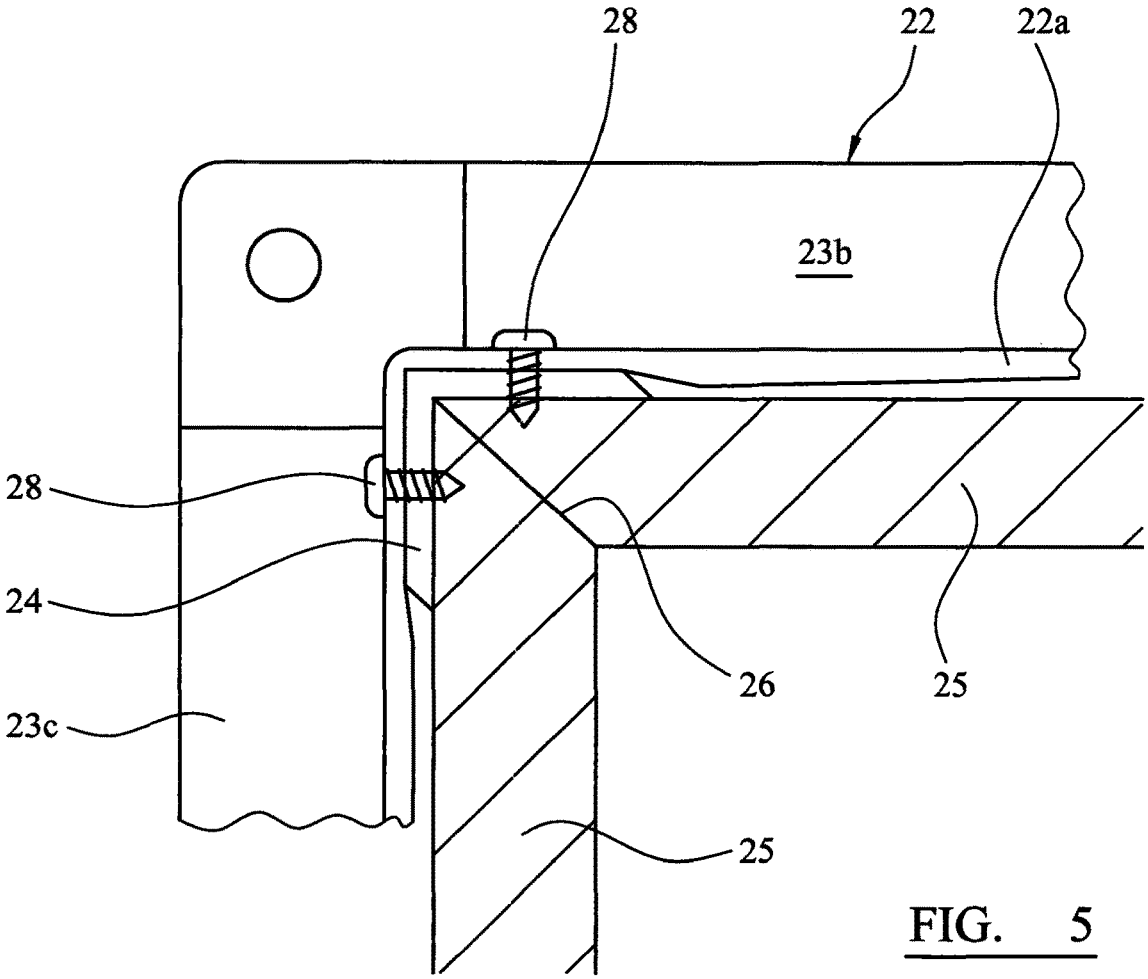
FIG. 5 shows a scrap view of a transverse section of the duct member.
Figure 6:
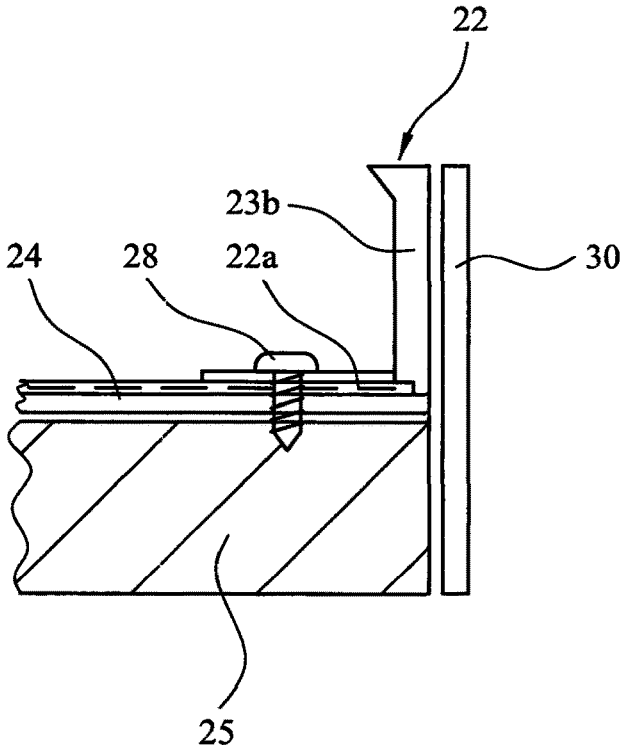
FIG. 6 shows a scrap side view of the duct member.

Referring now to FIGS. 5 and 6 in addition, there is shown scrap views of the manner in which the insulating boarding 25 is held securely in position. Further screws 28 are screwed through the walls of the frame elements 24 into the insulation boarding 25 to secure the insulation relative to the chassis. Although not shown, further screws may be used to secure the boarding 25 to the webs 22*a*.

A duct of the required length is obtained by assembling a plurality of the duct members illustrated together by securing the duct members through their flanges 22 by means of bolts passing through securing, holes 29 in the flanges. In a typical installation, a gasket 30 is located between adjacent flanges as shown in FIG. 6. When secured together in this way, the end faces of the insulation boarding in adjacent duct members abut to provide a continuous wall of insulated material throughout the duct with no gaps or bridges for leakage to take place. The use of the chassis with its framework on the outside of the insulation material provides a degree of protection to the boarding from cables etc passing over the ducting. This system all but removes the risk of cold bridging since only in extreme conditions of high temperature on one face combined with extreme low temperature on the opposing face and very high humidity would there be a very low risk of cold bridging and these conditions would not be encountered in normal use, At the same time, it provides a much lighter ducting which can be produced at much lower cost than the known schemes.

Although shown as a rectangular duct, it will be appreciated that other cross sections could be used. The sample, the duct could be, in cross-section, circular, flat oval or any shape that, would fit in with the building fabric or designers requirement's, using circular flat oval or any corresponding shape flanges with three or four frame elements securing the flanges together. In this case the cross section of the frame elements would be shaped to suit the profile such being arcuate for a circular duct. The thermally insulated boarding could be made of a flexible material for assembly in a factory or could be made by extruding a preformed rigid tube.

It will also be appreciated that although a single linear duct member is disclosed the invention is equally applicable to producing junctions such as T-shapes, bends or any item as normally used within the HVAC industry. Special shaped junction boxes could also be used. Although the embodiments described uses external flanges to secure the duct members together it will be understood that other forms of fastening may be used, which may be determined by the visual appearance required for the finished duct.

The invention claimed is:

1. A duct section for an air distribution system, the duct section including:

an elongate frame having two ends and opposed flange members at each end of the elongate frame, each flange member having an opening forming a duct section air passage therein;

a thermal insulating lining material installed during manufacture of the duct section so as to line the duct section to provide a thermally insulating lining to the duct section air passage, the thermal insulating lining material terminating with an end face, the thermal insulating lining compressible such that the end face is movable from a first position projecting beyond the flange members of the elongate frame to a second position flush with the flange members of the elongate frame; and a gasket formed of insulating material, the gasket positioned near the end face of the thermal insulating lining material;

wherein, in use, a first duct section is joined to a second adjacent duct section to form an air passage of a desired length, with the gasket of the first duct section located between the adjacent flange members of the first duct section and the second duct section thereby compressing the end face of the insulating lining of the first duct section to the second position and compressing the end face of the insulating lining of the second duct section to the second position, such that the insulating lining of the first duct section, the insulating lining of the second duct section, and the gasket provide a wall of insulated material throughout the first duct section and the second duct section to prevent cold bridging.

2. The duct section according to claim 1, wherein the elongate frame comprises a tubular element having the flange members at opposed ends.

3. The duct section according to claim 1, wherein the elongate frame comprises a plurality of elongate frame elements secured about a periphery of the flange members to define the elongate frame, thermal insulating boarding being secured between adjacent frame elements to define the air passage and to form the thermal insulating lining material.

4. The duct section according to claim 3, wherein the flange members are rectangular and are joined by four elongate frame elements secured to apices of the flange members to form a chassis.

5. The duct section according to claim 4, wherein the thermal insulating lining material is formed of a single sheet of material having V-shaped grooves cut along fold lines to enable the boarding to be folded into a rectangular tube for feeding into the chassis to form the duct section air passage.

6. The duct section according to claim 4, wherein the frame elements each have swages or folds therein to improve the bending resistance of the frame element.

7. The duct section according to claim 4, wherein the rectangular flange members have four right angles and wherein the flange members each have a web on each side of the right angle to enable four sections of the thermal insulating boarding to be secured to the frame elements.

8. The duct section according to claim 4, wherein the flange members are formed from planar sheet material, a web being formed from the sheet so as to extend outwardly at a right angle from a plane of the flange member so as to overlie the thermal insulating boarding.

9. The duct section according to claim 3, wherein the flange members each have a web extending outwardly from the flange member over the thermal insulating boarding with means to secure the thermal insulating boarding to the web.

10. The duct section according to claim 3, wherein the thermal insulating boarding has applied at manufacture to prevent moisture ingress at least one of the following:

a closed cell vapour proof skin;

a class 'O' foil faced plastic laminate vapour barrier skin; and a pure aluminium foil.

11. The duct section according to claim 1, wherein the gasket is made of thermal insulation material.

12. The duct section according to claim 1, wherein the end face of the thermal insulating lining material of the first duct section and the end face of the thermal insulating lining material of the second duct section are sealed with a foil tape which abuts the gasket when the first duct section and the second duct section are joined.

13. The duct section according to claim 1, wherein the thermal insulating lining material is secured to the elongate frame by a mastic adhesive.

14. The duct section according to claim 1, wherein an air gap between an inner surface of the elongate frame and the thermal insulating lining material is closed by mastic adhesive at the ends of the duct section.

15. The duct section according to claim 1, wherein the thermal insulating lining material is formed of an expanded or foamed plastics material.

16. The duct section according to claim 15, wherein the plastics material is a phenolic based material.

17. A duct section according to claim 1, wherein an air gap is formed between an inner surface of the elongate frame and the thermal insulating lining material, which air gap is sealed at adjacent ends of the duct section.

18. The duct section according to claim 17, in which the gasket is formed of an expanded or foamed plastics material.

19. The duct section according to claim 18, wherein the plastics material is a phenolic based material.

20. The duct section according to claim 1, wherein the insulating material is formed of a mineral wool or natural wool based material.

21. A duct section for an air distribution system, the duct section including:

an elongate frame having two ends and two opposed flange members, each flange member having an opening forming a duct section air passage therein;

a thermally insulating boarding lining the duct section to provide a thermally insulating lining to the duct section air passage, the thermally insulating boarding terminating with an end face, the thermally insulating boarding compressible such that the end face is movable from a first position projecting beyond the flange members of the elongate frame to a second position flush with the flange members of the elongate frame; and a gasket formed of insulating material, the gasket positioned near the end face of the thermally insulating boarding;

wherein, in use, a first duct section is joined to a second adjacent duct section to form an air passage of a desired length, with the gasket of the first duct section located between the adjacent flange members of the first duct section and the second duct section thereby compressing the end face of the thermally insulating boarding of the first duct section to the second position and compressing the end face of the thermally insulating boarding of the second duct section to the second position, such that the thermally insulating boarding of the first duct section and the thermally insulating boarding of the second duct section, and the gasket provide a wall of insulated material throughout the first duct section and the second duct section to prevent cold bridging;

wherein an air gap between an inner surface of the elongate frame and the thermally insulating boarding is closed by mastic adhesive at the ends of the duct section.

22. A duct section according to claim 21 wherein the thermally insulated boarding comprises a single sheet of boarding having spaced v-shaped grooves about which the board is hinged to line the duct section.

23. A duct section for an air distribution system, the duct section including:

two opposed rectangular flange members;

four elongate frame elements extending between and joining the two flange members, each elongate frame element having a L-shaped cross-section thereby forming a rigid open chassis;

thermally insulating boarding extending between each of the four elongate frame elements to form a rectangular tube, the thermally insulating boarding compressible such that end faces of the thermally insulating boarding are movable between a first position with the end faces projecting beyond the outer surfaces of the two flange members and a second position with the end faces flush with outer surfaces of the two flange members; and a gasket formed of insulating material positioned near one end face of the thermal insulating lining material such that, when a first of the duct sections is joined to a second of the duct sections, the gasket of the first duct section is located between the adjacent flange members of the first duct section and the second duct section thereby compressing the end face of the insulating lining of the first duct section to the second position and compressing the end face of the insulating lining of the second duct section to the second position, and the thermally insulating boarding of the first duct section, the thermally insulating boarding of the second duct section, and the gasket providing a wall of insulated material throughout the first duct section and the second duct section to prevent cold bridging.

24. A duct section according to claim 23 wherein the thermally insulated boarding comprises a single sheet of boarding having spaced v-shaped grooves about which the board is hinged to form the rectangular tube.

* * * * *